US005885105A

United States Patent [19]

Takagishi et al.

[11] Patent Number: 5,885,105

[45] Date of Patent: Mar. 23, 1999

[54] TERMINAL-LOCKING DEVICE-EQUIPPED CONNECTOR

[75] Inventors: Takashi Takagishi; Masanori Tsuji; Osamu Sugiyama, all of Shizuoka, Japan

[73] Assignee: Yazaki Corporation, Tokyo, Japan

[21] Appl. No.: 811,213

[22] Filed: Mar. 5, 1997

[30] Foreign Application Priority Data

Mar. 7, 1996 [JP] Japan ..... 8-049799

[51] Int. Cl.[6] ..... H01R 13/40

[52] U.S. Cl. ..... 439/595

[58] Field of Search ..... 439/545, 752

[56] References Cited

U.S. PATENT DOCUMENTS

| | | | |
|---|---|---|---|
| 5,112,080 | 5/1992 | Hatagishi et al. | 439/752 |
| 5,116,236 | 5/1992 | Colleran et al. | 439/752 |
| 5,203,722 | 4/1993 | Kinoshita | 439/595 |

FOREIGN PATENT DOCUMENTS

| | | |
|---|---|---|
| 64-54678 | 3/1989 | Japan . |
| 4-137474 | 5/1992 | Japan . |

*Primary Examiner*—Steven L. Stephan
*Assistant Examiner*—T C Patel
*Attorney, Agent, or Firm*—Armstrong, Westerman, Hattori, McLeland, & Naughton

[57] ABSTRACT

A connector housing has a terminal-accommodating chamber (4) and a mount opening (6) for a terminal-locking device, which communicates to the terminal-accommodating chamber (4). A terminal-locking device (2) with a resilient locking member (8) is mounted in the mount opening (6) to cause the resilient locking member (8) to engage with a terminal inserted into the terminal-accommodating chamber to lock the same in place in the chamber. The terminal-locking device, when mounted to the connector housing, reliably prevents the terminal from slipping rearwardly out of the terminal-accommodating chamber.

7 Claims, 5 Drawing Sheets

TERMINAL-LOCKING DEVICE-EQUIPPED CONNECTOR

BACKGROUND OF THE INVENTION

1. Field of the Invention

This invention relates to a connector equipped with a terminal-locking device which securely locks a terminal in place in a terminal-accommodating chamber of a connector housing.

2. Description of the Related Art

The fixing of a terminal in a terminal-accommodating chamber of a connector housing is generally effected by providing a terminal with an integral raised piece and engaging the raised piece with a bottom wall of the terminal-accommodating chamber, or by providing a ceiling wall of the terminal-accommodating chamber with an integral resilient locking arm and engaging the arm with a shoulder or in a hole of an electric contact of the terminal.

The raised piece and the locking arm, however, have a drawback that they are subject to damages on, among other things, repeated coupling and decoupling of connectors, resulting in the terminal slipping off or in a contact failure.

In view of such drawbacks, Japanese Patent Application Laid-Open Specification No. 64-54678 discloses a connector K provided with a mechanism for double-locking a terminal as shown in FIGS. 14 and 15.

In the connector K, a locking arm c is provided in each terminal-accommodating chamber b of a housing a, and throughholes d are provided in an outer peripheral wall of the housing a, which throughholes communicate to respective terminal-accommodating chambers b. An insertion pin e is inserted through the throughhole d to bring its locking projection el into engagement with a terminal f for double-locking the terminal f from slipping off.

The connector K, however, has a drawback that, since the locking arm c is integrally formed with the housing a by molding, it cannot be largely displaced for the structural reason, often resulting in insufficient locking of the terminal f.

Another drawback is that, since the locking arm c and the insertion pin e are separate parts, each molded from synthetic resin material, there are cases where size errors of molded pieces especially when doubled cause an insufficient locking of the terminal f, and where even when the terminal f is in incompletely inserted position in the terminal-accommodating chamber b, the insertion pin e is inserted irrespective of such position of the terminal f, resulting in a continuity failure.

SUMMARY OF THE INVENTION

This invention has been accomplished to overcome the above drawbacks and an object of this invention is to provide a terminal-locking device-equipped connector which reliably prevents a terminal from slipping out of its accommodating chamber of a connector housing.

In order to attain the objects, according to this invention, there is provided a terminal-locking device-equipped connector comprising: a connector housing having a terminal-accommodating chamber formed therein; a terminal-locking device provided with a resilient locking member, removably mountable to the connector housing such that a terminal inserted into the terminal-accommodating chamber is locked in place therein by the resilient locking member.

Preferably, the connector housing comprises, in addition to the terminal-accommodating chamber, a ceiling wall of the terminal-accommodating chamber, and a mount opening for the terminal-locking device, provided in the ceiling wall, and the terminal-locking device is mounted in the mount opening to bring the resilient locking member into locking engagement with a terminal inserted into the terminal-accommodating chamber.

Preferably, the terminal-locking device comprises opposed side walls between which the resilient locking member is located and locking projections at respective outer sides of the side walls, and the connector housing comprises, in addition to the terminal-accommodating chamber, a ceiling wall of the terminal-accommodating chamber, a mount opening for the terminal-locking device, provided in the ceiling wall, side walls of the chamber, and locking grooves formed at respective inner sides of the side walls, and when the terminal-locking device is mounted in the mount opening with the locking projections engaged in the locking grooves, the resilient locking member of the terminal-locking device fully engages with the terminal to lock the same in place.

Preferably, the terminal-locking device further comprises a projection engageable with the connector housing for locking the terminal-locking device to the connector housing in preliminary locked position.

Preferably, the projection is provided on the resilient locking member of the terminal-locking device and engages with an inner wall of the terminal-accommodating chamber.

Preferably, the resilient locking member extends parallel to a longitudinal direction of the terminal-locking device and has a locking claw at a front end thereof for engagement with the terminal.

Preferably, the terminal-locking device further comprises locking shoulders formed on the side walls of the terminal-locking device for engagement, when the terminal-locking device is mounted in the mount opening with the locking projections engaged in the locking grooves, with the terminal to double-lock the same in place.

Preferably, the resilient locking member comprises a locking claw having a locking recess for engagement therein of said terminal.

The above and other objects, features and advantages of this invention will become apparent from the following description and the appended claims, taken in conjunction with the accompanying drawings in which like parts or elements are denoted by like reference characters.

DESCRIPTION OF THE PREFERRED EMBODIMENTS

Embodiments of this invention will now be described with reference to the attached drawings.

Figure 1:
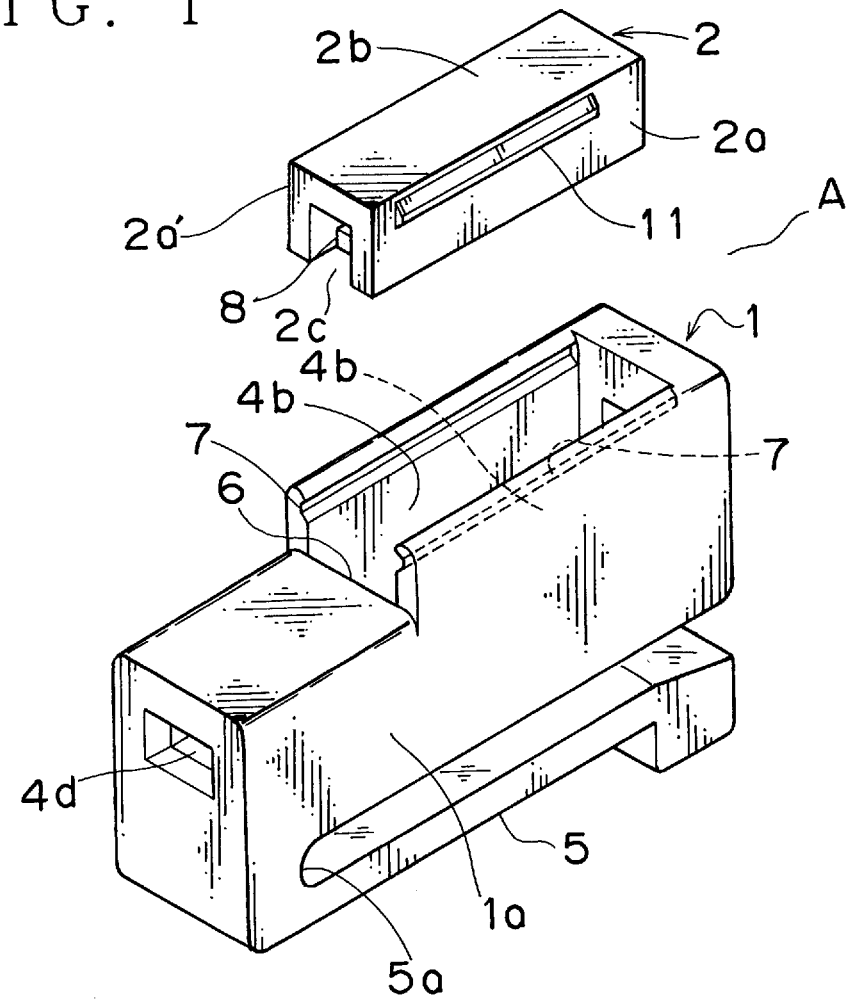
FIG. 1 is a perspective view of a terminal-locking device-equipped connector according to one embodiment of this invention, with the connector housing and locking device shown separated.
Figure 2:
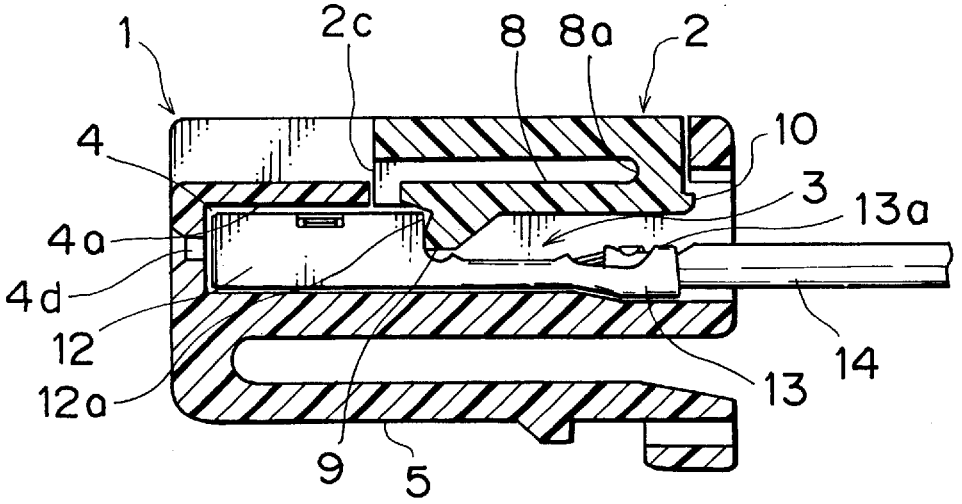
FIG. 2 is a longitudinal sectional view of the connector of FIG. 1, with the terminal-locking device fully locked to the connector housing.

FIG. 1 is a perspective view of a terminal-locking device-equipped connector A according to one embodiment of this invention, the terminal-locking device shown separated, and FIG. 2 is a sectional view of the terminal-locking device locking a female terminal in place.

The terminal-locking device-equipped connector A is comprised of a connector housing 1 which accommodates a female terminal 3, and a terminal-locking device 2 removably mounted to the connector housing.

The connector housing 1 has a terminal-accommodating chamber 4 defined by side walls 1*a*, and a locking arm 5 for locking the connector to a mating connector, which is provided via a rising base portion 5*a* to the front end of a bottom wall of the connector housing to extend parallel thereto.

A ceiling wall 4*a* of the terminal-accommodating chamber 4 is at a rear portion thereof largely cut away to provide a mount opening 6 for the terminal-locking device 2. Locking grooves 7, 7 are provided on opposite inner walls 4*b*, 4*b* of the terminal-accommodating chamber 4. A male terminal insertion opening 4*d* is provided in a front wall, communicating to the terminal-accommodating chamber 4.

The terminal-locking device 2 has a gate-shaped cross section, being comprised of opposed side walls 2*a*, 2*a*' and a ceiling wall 2*b* connecting therebetween. An opening 2*c* for insertion therethrough of a terminal removal jig is formed at the front end of the terminal-locking device 2, defined by the side walls 2*a*, 2*a*' and the ceiling wall 2*b*. A resilient locking piece 8 is, via a rising base 8*a*, provided on an inner surface of the ceiling wall 2*b* to extend forwardly in parallel thereto. The resilient locking piece 8 is at the free end thereof formed with a claw 9 for engagement with a terminal 3.

A locking projection 10 projects rearwardly at the rear side of the rising base 8*a* of the resilient locking piece 8 for preliminarily locking the terminal-locking device 2 to the connector housing 1. Locking projections 11 are provided at outer sides of both side walls 2*a*, 2*a*', the locking projections each having a substantially triangular cross section and extending parallel, when in the connector housing 1, to the longitudinal direction of the terminal-accommodating chamber 4.

A female terminal 3 has at a front portion thereof a female electric contact 12 and at a rear portion a wire-connecting portion 13 where a crimp piece 13*a* is crimped on a wire 14 for its connection to the female terminal 3.

The process of mounting the terminal-locking device 2 to the connector housing 1 and locking the female terminal 3 inserted into the terminal-accommodating chamber 4 of the connector housing 1 will now be described.

The terminal-locking device 2 is first inserted into the locking device mount opening 6 of the connector housing 1. At this time, the terminal-locking device 2 is not pushed in deep, but held in preliminary locked position in the connector housing 1, in which the locking projection 10 engages with a rear ceiling wall 4*c* of the terminal-accommodating chamber 4.

Figure 3:
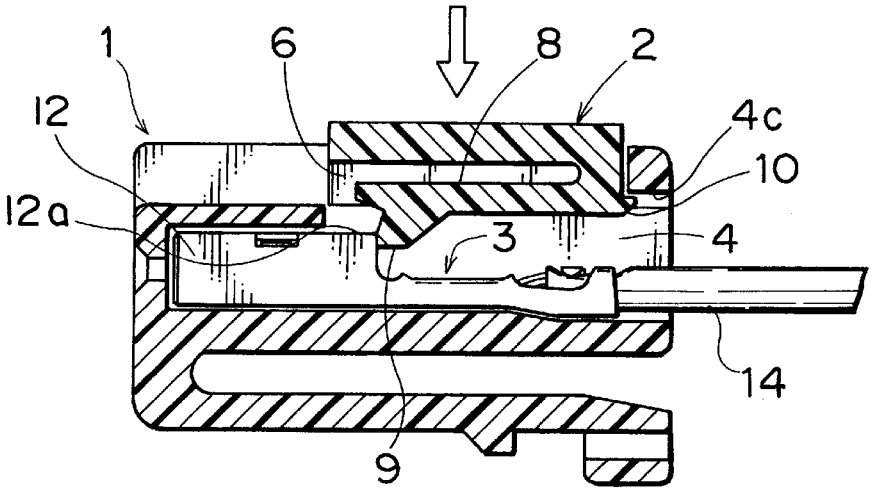
FIG. 3 is a sectional view of the connector housing of FIG. 1, with the terminal-locking device preliminarily locked thereto and a female terminal inserted.
Figure 4:
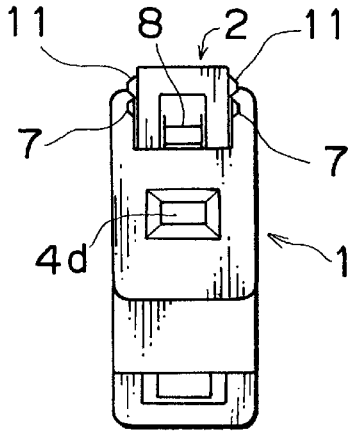
FIG. 4 is a front view of the connector housing of FIG. 3, with the terminal-locking device preliminarily locked.

A female terminal 3 is then inserted into the terminal-accommodating chamber 4 as shown in FIG. 3. The female terminal 3 advances to a predetermined position while displacing the locking claw 9 of the resilient locking member 8 upwardly and, when the locking claw 9 of the resilient locking member 8 restores its original position, engages with an electric contact shoulder 12*a* of the female terminal 3 to primarily lock the same (see FIG. 4), at which time the locking projections 11 of the terminal-locking device 2 do not yet engage in the locking grooves 7 of the connector housing 1. This state will be referred to as the primary locking of the female terminal 3 by the resilient locking member 8.

Figure 5:
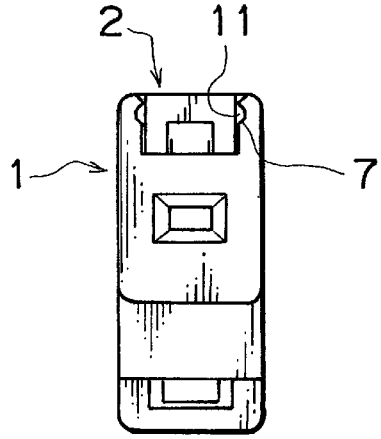
FIG. 5 is a front view of the connector housing of FIG. 2, with the terminal-locking device fully locked.
Figure 6:
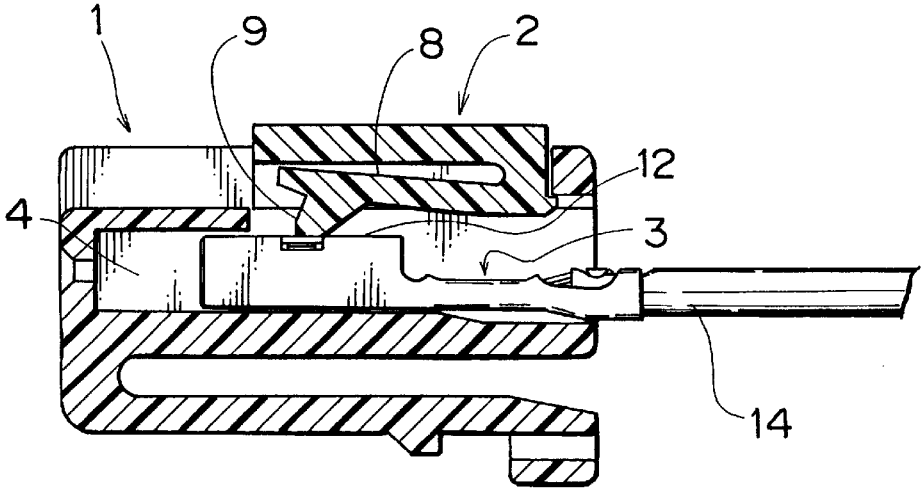
FIG. 6 is a sectional view showing the action of the terminal-locking device when pushed in, with the female terminal in incompletely inserted position in a terminal-accommodating chamber.

As shown in FIG. 2, if further pushed in the direction of an arrow, the terminal-locking device 2 advances deeper into the terminal-accommodating chamber 4 to enlarge the areas with which the locking claw 9 of the resilient locking member 8 and the shoulder 12*a* of the female terminal 3 engage with each other. The locking is thus strengthened. This state will be referred to as the secondary locking of the female terminal 3 by the resilient locking member 8. At this time, as shown in FIG. 5, the locking projections 11 of the terminal locking device 2 engage in the locking grooves 7 of the connector housing 1 to fully lock the terminal locking device 2 to the connector housing 1.

If on the other hand the female terminal 3 is in incompletely inserted position in the terminal-accommodating chamber 4, the locking claw 9 of the resilient locking member 8 abuts against the electric contact 12 of the female terminal 3 to disable the terminal-locking device 2 from being pushed in, making it possible to detect that the female terminal 3 is inserted incomplete.

Since the resilient locking member 8 of the terminal-locking device 2 advances deep into the terminal-accommodating chamber 4, the locking claw 9 can engage in large area with the shoulder 12*a* of the female terminal 3, making the secondary locking of the female terminal 3 by the resilient locking member 8 reliable.

Figure 7:
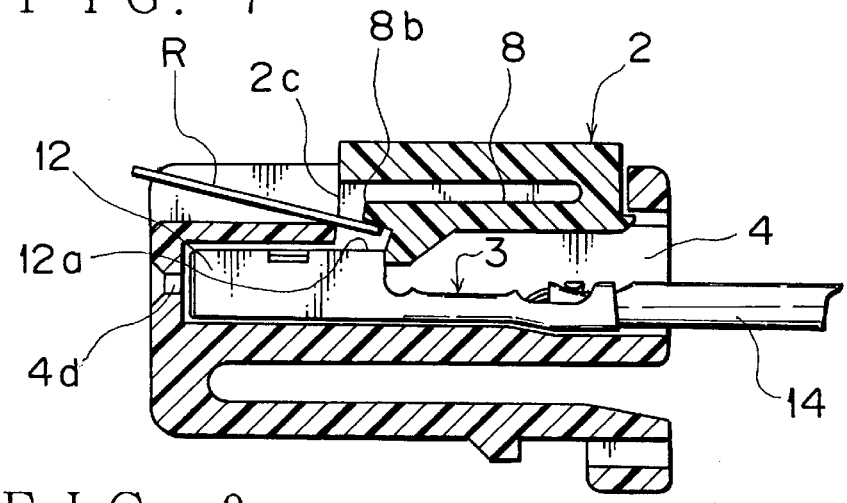
FIG. 7 is an explanatory view of the operation for pulling the female terminal out of the terminal-accommodating chamber.

To pull the female terminal 3 out of the terminal-accommodating chamber 4, as shown in FIG. 7, the terminal-locking device 2 is moved up to its preliminarily locked position to the connector housing 1, and a rod-like terminal removal jig R is then inserted through the opening 2*c* of the terminal-locking device 2 into a recess between the free end 8*b* of the resilient locking member 8 and the locking claw 9, followed by bending the resilient locking member 8 upwardly with the terminal removal jig R and releasing the engagement between the locking claw 9 and the shoulder portion 12*a* of the female terminal 3, at which time the female terminal 3 can be readily pulled out.

Figure 8:
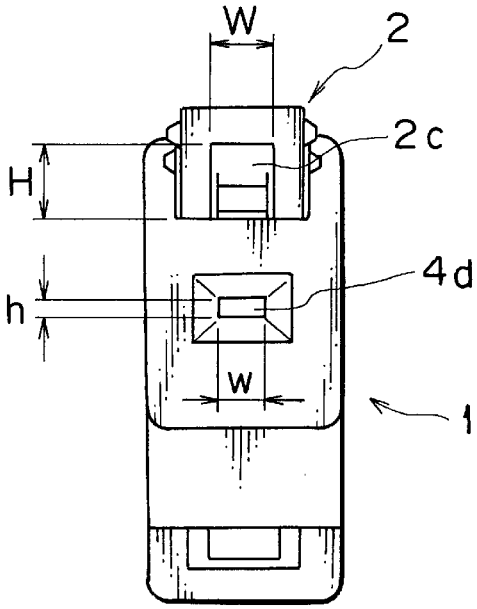
FIG. 8 is an explanatory view showing sizes of a jig insertion opening in the terminal-locking device and of a male terminal insertion opening in the connector housing.

As shown in FIG. 8, the dimension of the width W or height H of the opening 2*c* of the terminal-locking device 2 is preferably set larger than the larger one of the width and height dimensions w and h of the male terminal insertion opening 4*d*, and the terminal removal operation is effected by using a terminal removal jig R having dimensions not insertable into the male terminal insertion opening 4*d*, but insertable into the opening 2*c* of the terminal-locking device 2, so that the terminal removal jig R is prevented from being by accident inserted into the male terminal insertion opening 4*d* and giving damages to the internal female terminal 3.

Figure 9:
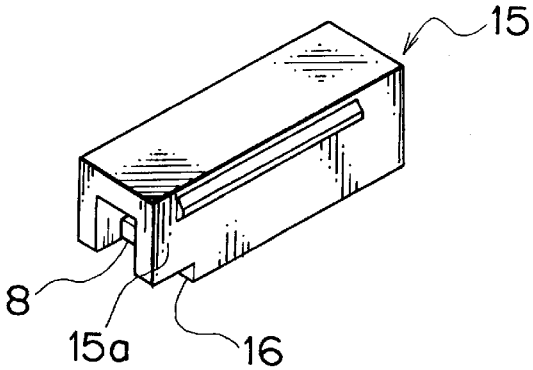
FIG. 9 is a perspective view of a terminal-locking device according to another embodiment of this invention.
Figure 10:
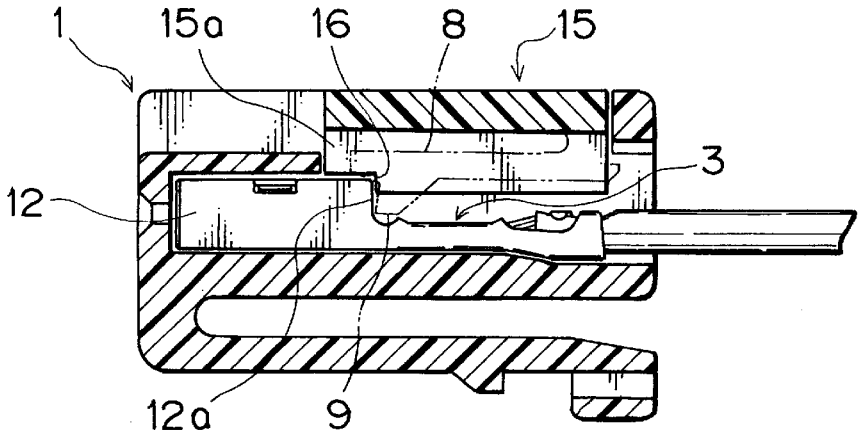
FIG. 10 is a sectional view of the connector housing, with the terminal-locking device of FIG. 9 mounted thereto in full locked position to lock a female terminal.

FIG. 9 is a perspective view of a terminal-locking device 15 according to another embodiment of this invention.

The terminal-locking device 15 is featured by locking steps or shoulders 16 provided at lower front ends of the side walls 15*a*, and has the same structure in other respects as the terminal-locking device 2 in the preceding example.

If the terminal-locking device 15 is mounted to the connector housing 1 in full locked position, in addition to the locking claw 9 of the resilient locking member 8, the locking shoulders 16 provided on the side walls 15*a* of the terminal-locking device 15 engage with the shoulder 12*a* of the female terminal electric contact 12 to double-lock the same in place, resulting in the locking of the female terminal further strengthened.

Figure 11:
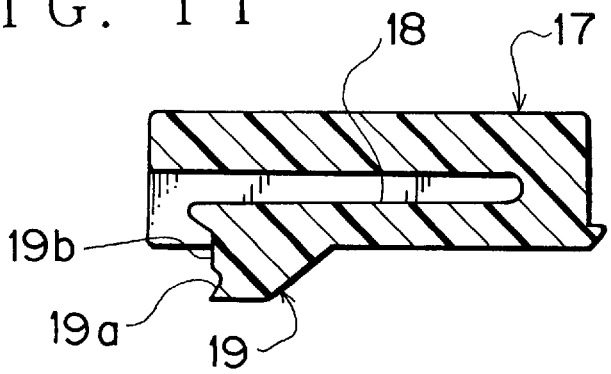
FIG. 11 is a sectional view of a terminal-locking device according to yet another embodiment of this invention.

FIG. 11 is a longitudinal sectional view of a terminal-locking device 17 according to yet another embodiment of this invention.

The terminal-locking device 17 is featured by the structure of its resilient locking member 18, and has the same structure in other respects as the terminal-locking device 2 as described hereinabove.

The locking claw 19 provided at the free end of the resilient locking member 18 has a vertical end surface 19*b* and a locking recess 19*a* therebelow for engagement therein of the terminal 3.

Figure 12:
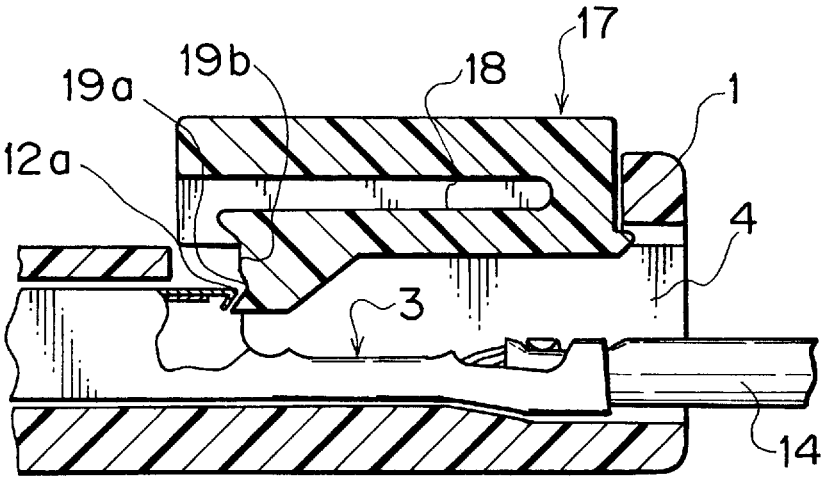
FIG. 12 is a sectional view showing a female terminal locked in primary locked position by a resilient locking member of the terminal-locking device of FIG. 11.

The locking recess 19*a* of the locking claw 19, as shown in FIG. 12, receives therein and engages with the shoulder 12*a* of the female terminal 3 in the primary locking of the terminal 3, with the shoulder 12*a* being guided along a lower inwardly inclined surface of the locking recess 19*a*. Thus, if the female terminal 3 in the primary locked position is pulled at its wire 14, the tensile force acts in such a direction as to cause the shoulder 12*a* of the female terminal 3 to advance into the locking recess 19*a*, securely preventing the terminal 3 from slipping off rearwardly.

Figure 13:
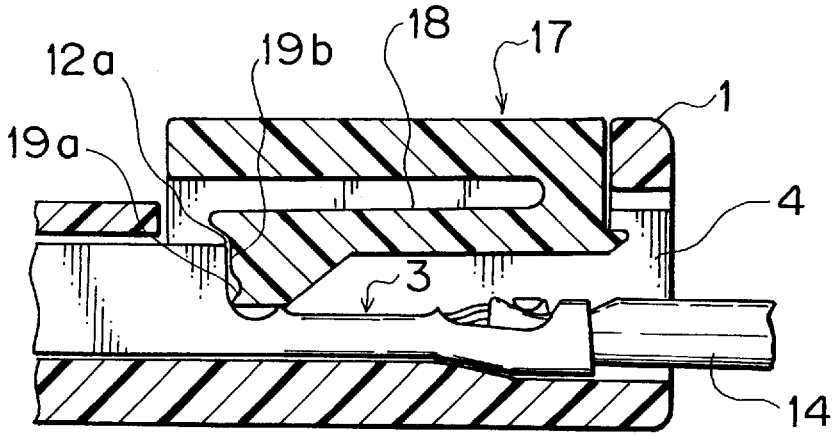
FIG. 13 is a sectional view showing the female terminal locked in secondary locked position by the resilient locking member of the terminal-locking device of FIG. 11.
Figure 14:
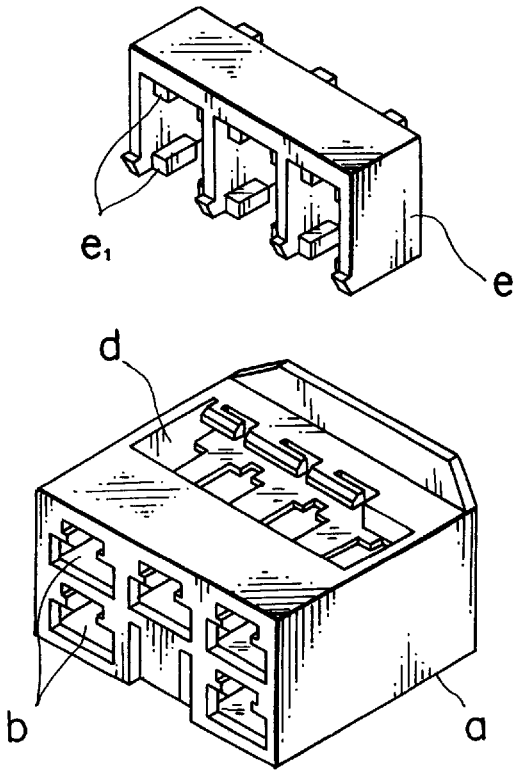
FIG. 14 PRIOR ART
FIG. 14 is a perspective view of a conventional terminal-locking device-equipped connector.
Figure 15:
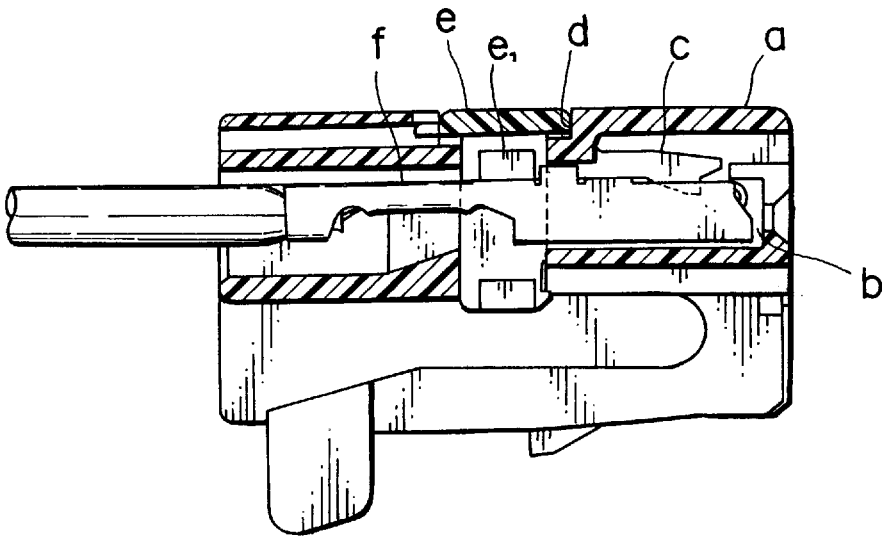
FIG. 15 PRIOR ART
FIG. 15 is a sectional view of a connector housing of FIG. 14, with a terminal inserted and locked.

When the resilient locking member 18 is further moved into the terminal-accommodating chamber 4 and locks the female terminal 3 in the secondary locking position, as shown in FIG. 13, the locking end surface 19*b* of the locking claw 19 is brought into contact with the female terminal 3, thereby minimizing the gap between the shoulder 12*a* of the female terminal 3 and the locking claw 19 which would be otherwise made large by the locking recess 19*a*. Due to the above, plays of the female terminal 3 in the terminal-accommodating chamber 4 are prevented.

While in the above examples, the connector housing 1 is shown to have a single terminal-accommodating chamber 4, it is also possible to use a connector housing with a plurality of terminal-accommodating chambers and to lock a plurality of terminals in place in these terminal-accommodating chambers at one time with a terminal-locking device provided with a number of resilient locking members corresponding to the terminal-accommodating chambers.

As described hereinabove, in the terminal-locking device-equipped connector according to this invention, the resilient locking member for locking a terminal in the connector housing is provided on the terminal-locking device which is separate from the connector housing, and the terminal-locking device is moved into the connector housing to bring the resilient locking member into engagement with the terminal and lock the terminal in place in the connector housing. As a result, the terminal-locking device can be moved deep into the connector housing, enabling the resilient locking member to securely engage and lock the terminal if size errors are caused at the time of molding. Further, by providing the locking steps or shoulders on side walls of the terminal-locking device, which double-locks the terminal together with the resilient locking member, the locking of the terminal is enhanced, resulting in a largely improved reliability.

Having now fully described the invention, it will be apparent to one of ordinary skill in the art that many changes and modifications can be made thereto without departing from the spirit and scope of the invention as set forth herein.

What is claimed is:

1. A terminal-locking device-equipped connector comprising:

a connector housing having a terminal-accommodating chamber formed therein; and a terminal-locking device provided with a resilient locking member, wherein said terminal-accommodating chamber has a ceiling wall bordered by opposing side walls, said side walls of said terminal-accommodating chamber have respective portions which extend past the ceiling wall at a mount opening in said ceiling wall, said mount opening communicates longitudinally with a terminal inserted into said terminal-accommodating chamber, said respective portions of said side walls extending past said ceiling wall at said mount opening engageably receive said terminal-locking device which is removably mounted therein to bring said resilient locking member into locking engagement with said terminal inserted into said terminal-accommodating chamber.

2. The terminal-locking device-equipped connector according to claim 1, wherein said opposing side walls of said terminal-accommodating chamber have locking grooves at respective inner sides of said respective portions extending past said ceiling wall, wherein said terminal-locking device comprises opposed side walls between which said resilient locking member is located and locking projections at respective outer sides of said side walls, and wherein when said terminal-locking device is mounted in said mount opening with said locking projections engaged in said locking grooves, said resilient locking member of the terminal-locking device fully engages with said terminal to lock the same in place.

3. The terminal-locking device-equipped connector according to claim 2, wherein said terminal-locking device further comprises a projection engageable with said connector housing for locking said terminal-locking device to said connector housing in a preliminary locked position.

4. The terminal-locking device-equipped connector according to claim 3, wherein said projection is provided on said resilient locking member of the terminal-locking device and engages with an inner wall of said terminal-accommodating chamber.

5. The terminal-locking device-equipped connector according to claim 2, wherein said resilient locking member extends parallel to a longitudinal direction of said terminal-locking device and has a locking claw at a front end thereof for engagement with said terminal.

6. The terminal-locking device-equipped connector according to claim 2, wherein said terminal-locking device further comprises locking shoulders formed on said side walls of the terminal-locking device for engagement, when said terminal-locking device is mounted in said mount opening with said locking projections engaged in said locking grooves, with said terminal to double-lock the same in place.

7. The terminal-locking device-equipped connector according to claim 2, wherein said resilient locking member comprises a locking claw having a locking recess for engagement therein of said terminal.

* * * * *